US005531174A

United States Patent [19]

Norz et al.

[11] Patent Number: 5,531,174

[45] Date of Patent: Jul. 2, 1996

[54] SEWING MACHINE FOR SEWING SEAMS ON A TUBULAR WORKPIECE

[75] Inventors: Wolfgang Norz, Schweiberdingen; Günter Rohr, Hemmingen, both of Germany

[73] Assignee: Union Special GmbH, Germany

[21] Appl. No.: 289,924

[22] Filed: Aug. 12, 1994

[30] Foreign Application Priority Data

Aug. 13, 1993 [DE] Germany ..... 9312091 U

[51] Int. Cl.[6] ..... D05B 21/00; D05B 35/06

[52] U.S. Cl. ..... 112/470.29; 112/470.33

[58] Field of Search ..... 112/470.29, 470.02, 112/470.07, 470.31, 470.33, 475.02, 475.03, 305, 306, 308, 309, 63

[56] References Cited

U.S. PATENT DOCUMENTS 4,602,579 7/1986 Pollmeier .
4,730,566 3/1988 Brophy et al. ..... 112/470.07
5,029,541 7/1991 Rohr et al. .
5,131,336 7/1992 Kono et al. ..... 112/470.29
5,188,047 2/1993 Rohr et al. .
5,269,239 12/1993 Adamski, Jr. ..... 112/470.29

FOREIGN PATENT DOCUMENTS 756669 9/1956 United Kingdom .
1349350 4/1974 United Kingdom .

*Primary Examiner*—Peter Nerbun

[57] ABSTRACT

A sewing unit comprises a sewing machine having a guide device for a binding. A controlled positionable guide member of the guide device makes it possible to sew a binding on an endless edge of a workpiece portion by means of a plurality of separately sewing seams.

14 Claims, 5 Drawing Sheets

SEWING MACHINE FOR SEWING SEAMS ON A TUBULAR WORKPIECE

BACKGROUND OF THE INVENTION

The invention relates to a sewing machine for the automatic sewing of an endless edge on an elastic portion of a workpiece, having a guide device for guiding the edge towards a sewing location of the sewing machine.

A sewing machine of this type is disclosed in U.S. Pat. No. 5,029,541. There is disclosed in this patent the method of sewing, largely automatically, a seam on openings of different widths on workpiece portions that have a certain elasticity. The tension, required for this sewing operation, is automatically adjusted.

SUMMARY OF THE INVENTION

An object of the invention is to provide a sewing machine for sewing a binding on an endless edge of an elastic portion of a workpiece in such a way that high quality elastic multi-seam binding may be formed in a simple and inexpensive manner.

In accordance with the present invention, there is provided a sewing machine for the automatic sewing of an endless edge of an elastic portion of a workpiece, comprising a guide device for guiding the edge towards a sewing location of the sewing machine and an adjustable tensioning member for applying a specific tension, to be maintained for the sewing operation, of the relevant edge of the portion of the workpiece, wherein for a binding associated with the edge of the portion of the workpiece, the guide device is operable in such a way that a first position or a second position of the guide device is selectively controlled transversely to the feed direction of the workpiece, and a separate seam produced by the sewing machine is in each case thereby associated with the binding, wherein the completion of the respective seam is derivable from a signal relating to the start of the seam.

With the sewing machine in accordance with this invention, that is, a single-seam sewing machine with a laterally displaceable binding guide device for producing a multi-seam binding which has successively produced sewing seams which may be of a highly elastic nature corresponding to the type of stitch selected, for example classes 400 or 600 of ISO 4915, it is possible to produce high-quality multi-seam bindings in a simple and inexpensive manner on endless workpiece portions. This is possible because from the point of view of the type of stitch, only a single-seam sewing machine is required, rather than a multi-seam sewing machine that has a lower sewing speed than a single-seam sewing machine and in which the handling of the binding to be sewn requires special skill on the part of the operator.

There is disclosed in U.S. Pat. No. 5,188,047, that, in the case of annularly endless seams, the completion of the respective seam is derivable from a signal relating to the start of the seam.

In one embodiment the signal, relating to the start of the seam, for the completion of the seam is derived by means of a predetermined number of stitches. This makes possible the largely automated production of elastic bands on workpiece portions with different widths of opening.

In another embodiment the sewing machine includes a computer which causes an adjusting means to be positioned in such a way that the change in the distance between the tensioning member and the sewing location produces in the mounting region of the tensioning member a force which corresponds to the required tension in the portion of the workpiece. This force is detected by an actual value pick-up located in the mounting region of the tensioning member and is fed back to the computer, so that the tension corresponding to a desired value is obtainable before the commencement of the sewing operation. This makes it possible to produce elastic bindings on workpiece portions with constant pretension of the bindings, wherein use is made substantially of features shown in the above identified U.S. Pat. No. 5,029,541.

In one embodiment of the invention the guide device has an adjustable stop for limiting the transverse movement of the feed device or of a guide member. In one construction an adjustable stop for determining the width of the binding is associated with the guide member of the guide device. These features make it possible to produce bindings of different widths and with different spacing between the seams. In one embodiment the guide member is secured in the guide device so as to be laterally adjustable. This makes it possible to accurately position the first seam. This feature can be used, for example, to overlap or oversew an over-edge seam, previously provided on the workpiece portion, for the purpose of securing an annular rubber band to the edge of the workpiece.

By way of example only, a specific embodiment of the present invention will now be described, with reference to the accompanying drawings.

DETAILED DESCRIPTION OF THE PRESENTLY PREFERRED EMBODIMENTS

Figure 1:
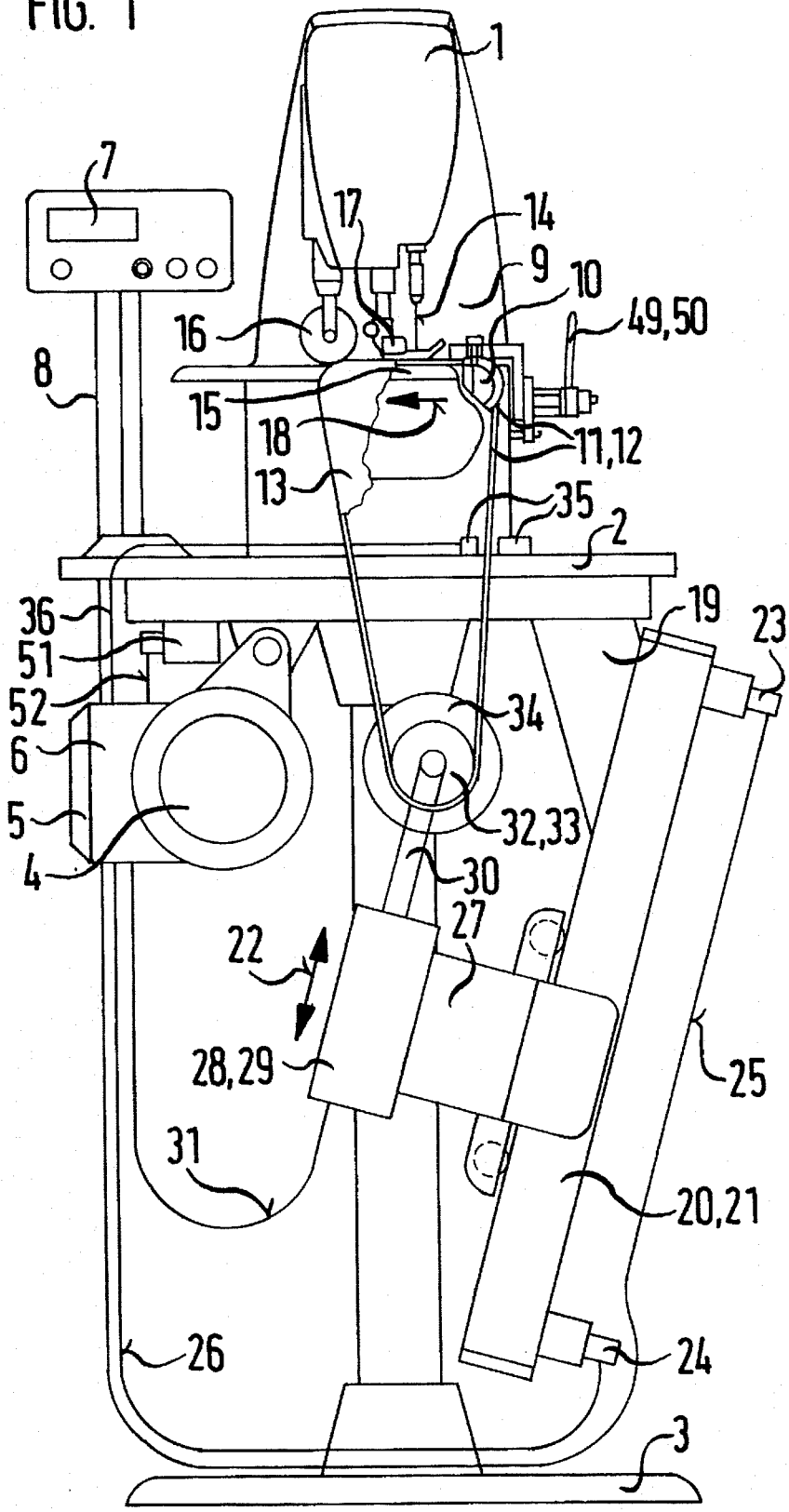
FIG. 1 is a view from the left of an embodiment of sewing machine in accordance with the invention.

Referring to FIG. 1, a sewing machine 1 is mounted in a known manner on a table plate 2 carried by a support 3. A drive motor 4 is suspended from the table plate 2 and has a control device 5, which includes a computer 6, for the sewing machine 1. Furthermore, the table plate 2 carries a control panel 7 which makes it possible to change and/or call up one or more values stored in the computer 6 and which is connected to the control device 5 by way of a cable 8. Located upstream of a sewing location 9 of the sewing machine 1 is a guide device 10 for guiding an endless edge 11 of a binding 12 which is to be sewn automatically and which is disposed on the endless edge 11 of a workpiece portion 13 and which is guided towards the sewing location 9 by means of the guide device 10.

The sewing machine 1 has a sewing needle 14, or a plurality thereof, which are movable upwardly and downwardly and which passes through a needle plate 15 during the sewing operation. A puller roller 16, disposed downstream of a presser device 17, serves additionally to assist the advance of the workpiece by the sewing machine 1. An arrow 18 indicates the feed direction of the workpiece.

A holder 19 secured to the support 3 carries a double-acting pressure-medium cylinder 21, that functions as an adjusting means 20, the movement of which is indicated by a double arrow 22. The cylinder 21 is controlled by the computer 6 or by the control device 5 through solenoid valves 23 and 24 respectively by way of electric cables 25 and 26. A reception plate 27, that is movable upwardly and downwardly, is disposed in the pressure-medium cylinder 21 to which pressure medium, compressed air for example, is admitted by way of pressure-medium lines not shown in the drawings. The reception plate 27 carries an actual value pick-up 28 which acts as a displacement pick-up and which is in the form of a known incremental pick-up 29 in which a coated plate (not shown) scans a plurality of sensors and at the same time evaluates the movement of a spring-loaded pin 30 and signals the results to the computer 6 by way of a cable 31. The free end of the pin 30 carries a guide member 32 which is partially embraced by the pretensioned binding 12 or the workpiece portion 13 and which is in the form of a wheel 33 and includes a disc 34 for guiding the binding 12.

The position of the tensioning member 32 relative to the sewing location 9 may also be predetermined by means of, for example, a known threaded spindle drive which is secured to the support 3 and which moves the tensioning member 32 upwardly and downwardly by means of a crank.

A sensor 35, which is connected to the computer 6 by a cable 36, senses the start of the sewn binding 12 approaching the sewing needle or needles 14, that is, the start of the seam.

Figure 2:
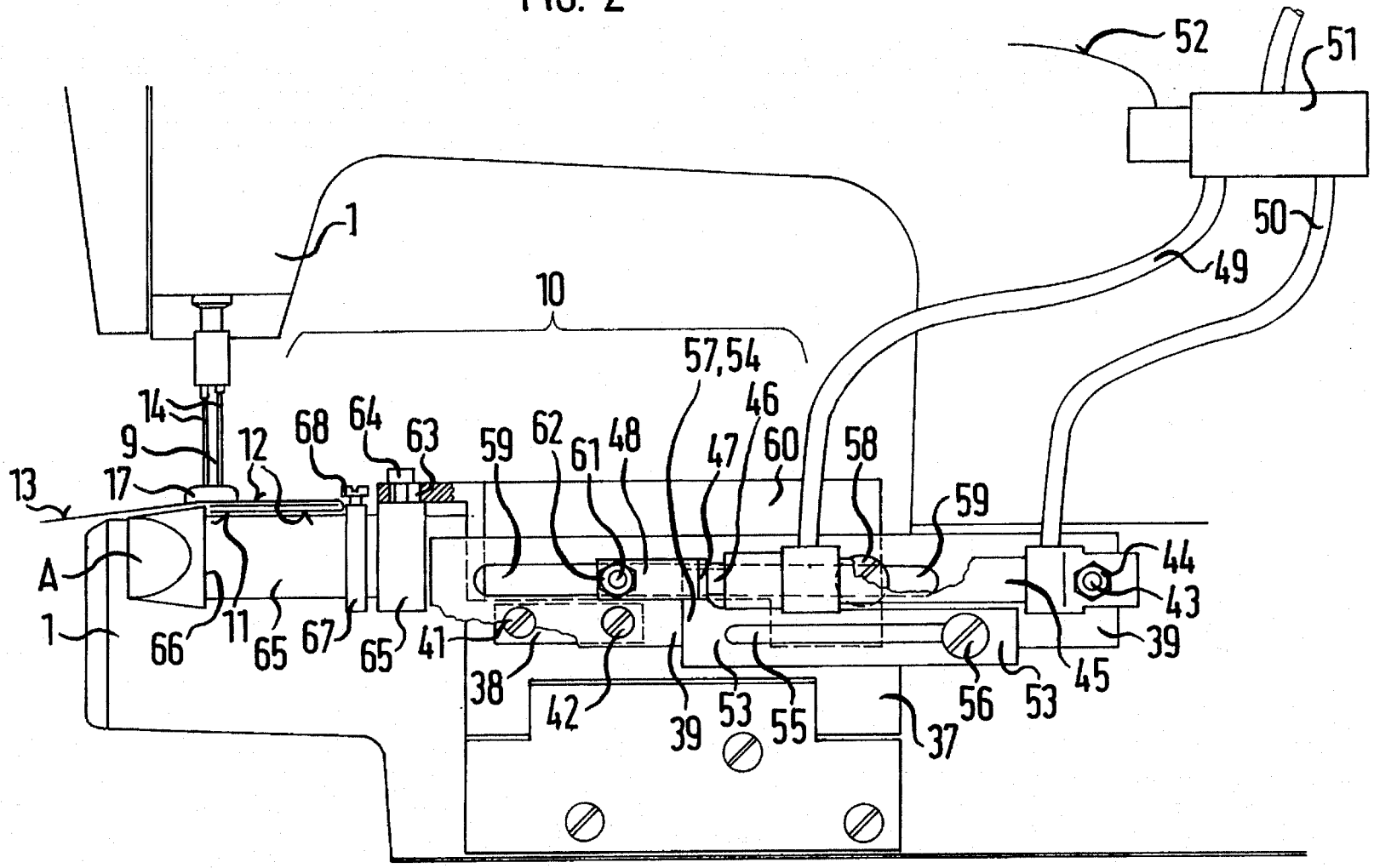
FIG. 2 is a fragmentary front view of the embodiment of FIG. 1, with a guide device being in a first position A.

FIG. 2 shows the guide device 10 in a first position A. A spacer 38, disposed on a swivel plate 37 of the sewing machine 1, carries a support plate 39 which is secured to the swivel plate 37 by means of screws 41 and 42. A spacer bolt 43 is disposed on the support plate 39 and carries a double-acting pressure-medium cylinder 45 which is secured by a nut 44 and to which pressure medium is admitted. A piston rod 46 extends out of the pressure medium cylinder 45 and carries a head piece 48 secured by a nut 47. Respective pressure medium lines 49 and 50 are connected to a solenoid valve 51 which, referring to FIG. 1, is secured to the support 3 and is connected to the control device 5 of FIG. 1 by a cable 52. This makes it possible to reciprocate the piston rod 46 in a controlled manner.

A stop piece 53 has a lug 54 and an opening 55, in the form of a slotted hole, through which engages a screw 56 by means of which the stop piece 53 is secured to the support plate 39 so as to be laterally adjustable. The lug 54 serves as a stop 57 for a collar screw 58 which extends through a guide slot 59 of the support plate 39 and which is secured to bracket 60 which is movable back and forth.

A collar bolt 61, which also extends through the guide slot 59, is secured to the headpiece 48 by a nut 62 and is secured to the bracket 60. Two-way actuation of the pressure-medium cylinder 45 by means of pressure medium makes it possible to displace the bracket back and forth. The limitation of the stroke of the piston rod 46 is effected in the pressure-medium cylinder 45 on the one hand, and on the other hand, by abutment of the collar screw 58 against the stop 57. A guide member 65 is laterally adjustable secured to the bracket 60, by a screw 64 that extends through a slotted hole 63 in the bracket 60. This makes possible a lateral alignment of a binding guide edge 66 which guides, for example, the folded-over edge 11 of the workpiece portion 13 and thus the left-hand side of the binding 12. The right-hand side of the binding 12 is guided by means of a further stop 67 which is laterally adjustably secured to the binding guide piece 65 by means of screw 68.

Figure 3:
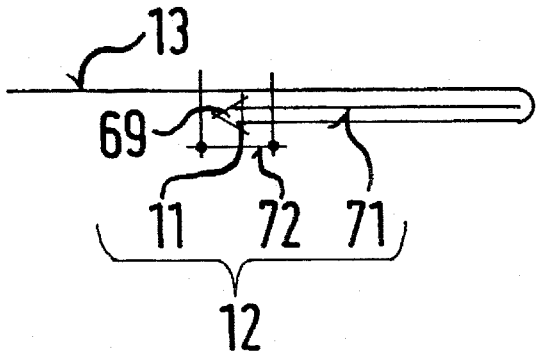
FIG. 3 is a diagrammatic illustration of a binding after sewing or oversewing, in a first position A.

FIG. 3 is a diagrammatic illustration of the binding 12. An annular elastic binding 71 is sewn to the endless edge 11 of the elastic workpiece portion 13 by means of an over-edge seam 69, for example stitch type 503 or 504 in accordance with ISO 4915. The workpiece portion 13 folded over about the open or endless binding 71, such as a rubber band, is sewn by means of a first seam 72. Seam 72 is, for example, stitch type 406 as is shown, or any mechanically produced seam in accordance with ISO 4915.

Figure 4:
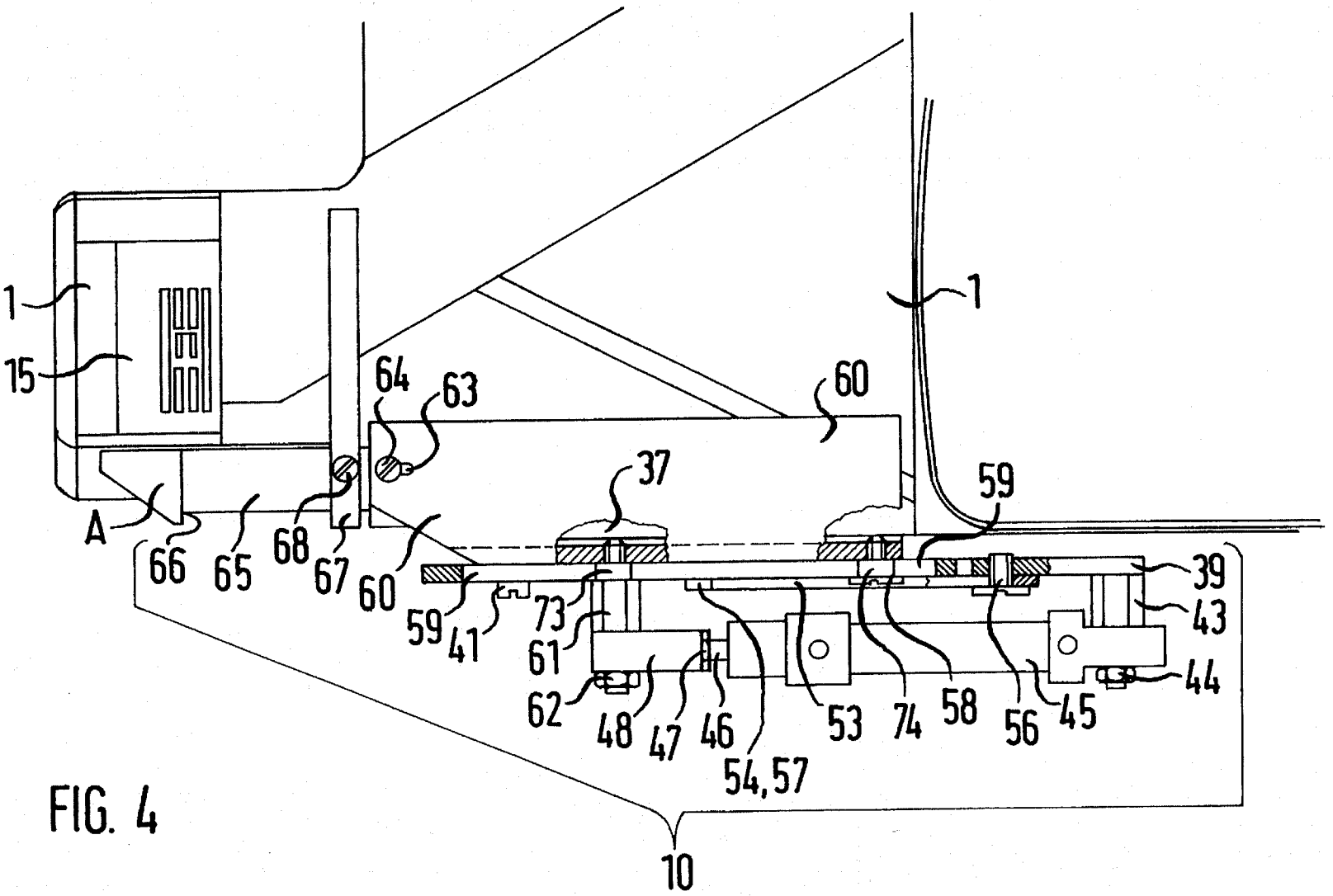
FIG. 4 is a fragmentary plan view of the embodiment of FIG. 1, the guide device being in a first position A.

FIG. 4 shows the arrangement of the guide device 10 on the sewing machine 1. An annular shoulder 73 of the collar bolt 61, and a further annular shoulder 74 of the collar screw 58, make possible the lateral guidance of the bracket 60 in the guide slot 59.

Figure 6:
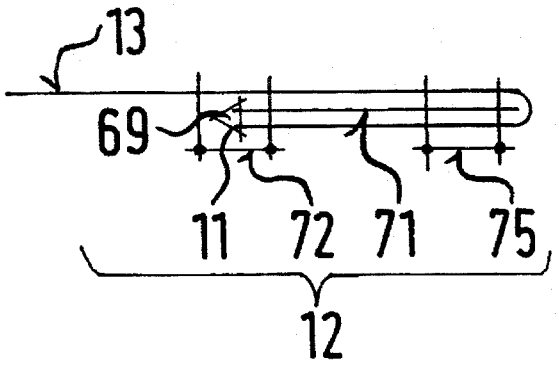
FIG. 6 is a diagrammatic illustration of a binding after repeated sewing, in a further position B.
Figure 5:
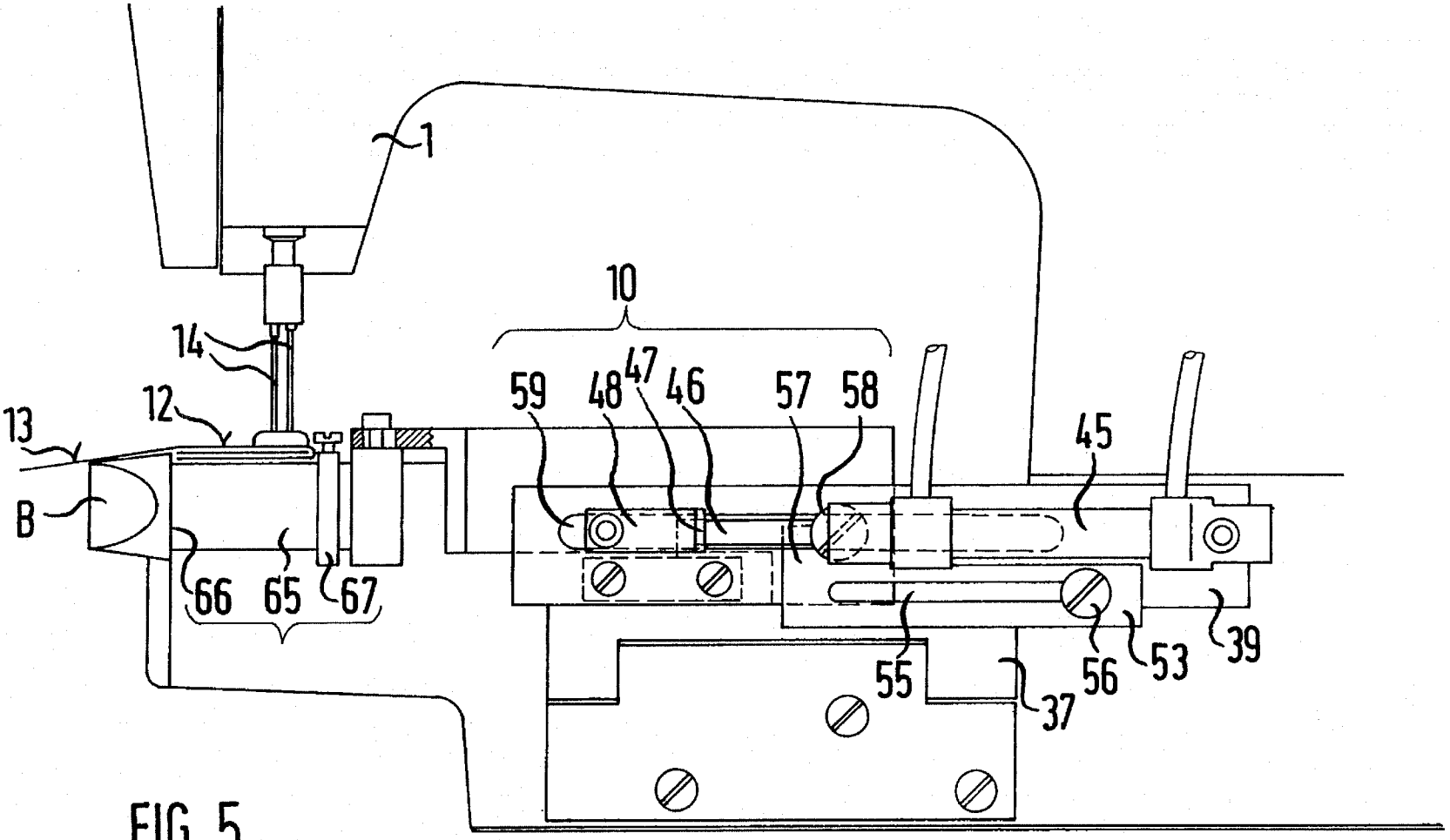
FIG. 5 is a fragmentary front view of the embodiment of FIG. 1, the guide device being in a further position B.

FIG. 5 shows the pressure-medium cylinder with the piston rod 46 extended. The collar screw 58 is at the same time urged against the stop 57, and thus the guide device 10 is disposed in its further position B. This makes it possible to sew the binding 12 of the workpiece portion 13 with a further, separate seam 75 of FIG. 6.

The mode of operation of the sewing unit will be described hereinafter:

The workpiece portion 13 having, for example, an elastic band 71 which is already provided on the edge 11, and which may be finite or endless and may be, for example, sewn or glued thereto, is, in a manner known per se, tensioned by way of the tensioning member 32 and also placed under the pressure device 17. The actual value pick-up 28 ascertains the tension or actual force present in the workpiece portion 13 or in the binding 12 respectively and signals it to the computer 6 which compares the tension or force with at least one preselectively stored desired force. The adjusting means 20 is actuated when the desired force differs from the actual force, and pretensions the tensioning member 32 to a greater or lesser extent until the desired pretension of the opening in the workpiece is attained. Thus, it is possible to always obtain the same pretension, even in the case of elastic bands 71 of different sizes or in the case of endless edges 11 of different sizes which may result from, for example, manufacturing tolerances or from workpieces of different sizes. The actual sewing operation is initiated in a known manner after the desired force has been attained.

The presser device 17 is lowered, if it has not already been lowered upon tensioning of the workpiece portion 13, and the sewing machine 1 commences with the sewing operation. The guide device 10 having the controlled positionable guide member 65 is at the same time located in position A. By virtue of, for example, a mark previously provided, the sensor 35, disposed upstream of the needle or needles 14 for example, detects, during the advance of the workpiece, the seam 72 already sewn and, after a preselectable number of stitches, the first seam 72 is completed, the sewing thread is cut, and the presser device 17 is raised. The length of the stitches may also be determined by means of a preselectively determined number of stitches, that is, exclusively by counting the stitches. The pressure-medium cylinder 45 is then reversed and the guide member 65 is brought into the further position B, and thus the binding 12 is displaced laterally by a predetermined, adjustable distance of, for example up to 40 mm, since the binding 12 is adjustably and laterally guided between the binding guide edge 66 and the stop 67. The presser device 17 is lowered again, and the binding is sewn with the further seam 75. When using a multi-position pressure-medium cylinder having, for example, three positions, a third seam may also be provided. By virtue of the adjustable stops 67 and 57, high-quality bindings 12 of different widths, as well as high-quality seams 72, 75 spaced at different distances apart, may be produced in an advantageous and inexpensive manner.

While the invention has been described in detail with particular reference to the illustrated apparatus, it is to be understood that variations, modifications and the use of equivalent mechanisms can be effected without departing from the scope of the invention. It is, therefore, intended that such changes and modifications be covered by the following claims.

What is claimed is:

1. A sewing machine for the automatic sewing of an endless edge of an elastic portion of a workpiece, comprising a guide device for guiding the edge towards a sewing location of the sewing machine and an adjustable tensioning member for applying a specific tension to the workpiece, said specific tension to be maintained for the sewing operation of said edge of the workpiece, wherein a binding including a separate seam is produced along said edge of the workpiece, said guide device being constrained for movement between first and second extreme positions and movable transversely to the feed direction of the workpiece by a power operated mechanism that includes a fully extended position that establishes said first position of said guide device, an adjustable stop supported by the sewing machine that establishes said second position of the guide device, a sensor that senses the beginning of said separate seam as it approaches said sewing location and creates a signal indicating the location of the beginning of said separate seam relative to said sewing location wherein the completion of said separate seam is derivable from said signal.

2. A sewing machine as claimed in claim 1, wherein said signal, relating to the start of the seam, causes the completion of the seam to be derived by means of a predetermined number of stitches.

3. The invention as set forth in claim 1, further comprising a computer which positions an adjusting means in such a way that the change in the distance between said adjustable tensioning member and the sewing location produces in the mounting region of the tensioning member a force which corresponds to the required tension in the portion of the workpiece and which is detected by an actual value pick-up located in the mounting region of the tensioning member and is fed back to the computer, so that the tension corresponding to a desired value is obtainable before the commencement of the sewing operation.

4. The invention as set forth in claim 1, wherein said adjustable stop determines the width of the binding.

5. The invention as set forth in claim 1, wherein a guide member is secured to said guide device so as to be laterally adjustable therewith.

6. The invention as set forth in claim 4, wherein a guide member is secured to said guide device so as to be laterally adjustable therewith.

7. The invention as set forth in claim 2, further comprising a computer which positions an adjusting means in such a way that the change in the distance between the tensioning member and the sewing location produces in the mounting region of the tensioning member a force which corresponds to the required tension in the portion of the workpiece and which is detected by an actual value pick-up located in the mounting region of the tensioning member and is fed back to the computer, so that the tension corresponding to a desired value is obtainable before the commencement of the sewing operation.

8. The invention as set forth in claim 2, wherein a guide member is secured to said guide device so as to be laterally adjustable therewith.

9. The invention as set forth in claim 3, wherein said adjustable stop determines the width of the binding.

10. The invention as set forth in claim 3, wherein said adjustable stop determines the width of the binding.

11. The invention as set forth in claim 2, wherein a guide member is secured to said guide device so as to be laterally adjustable therewith.

12. The invention as set forth in claim 3, wherein a guide member is secured to said guide device so as to be laterally adjustable therewith.

13. The invention as set forth in claim 10, wherein a guide member is secured to said guide device so as to be laterally adjustable therewith.

14. The invention as set forth in claim 7, wherein a guide member is secured to said guide device so as to be laterally adjustable therewith.

* * * * *

UNITED STATES PATENT AND TRADEMARK OFFICE

CERTIFICATE OF CORRECTION

PATENT NO. : 5,531,174

DATED : July 2, 1996

INVENTOR(S) : Wolfgang Norz et al.

It is certified that error appears in the above-identified patent and that said Letters Patent is hereby corrected as shown below:

In Claim 10, line 1, replace "3" with --7--.

Signed and Sealed this

Thirtieth Day of June, 1998

*Attest:*

*Attesting Officer*

Bruce Lehman

BRUCE LEHMAN

*Commissioner of Patents and Trademarks*